US008000959B2

(12) United States Patent
Kim

(10) Patent No.: US 8,000,959 B2
(45) Date of Patent: Aug. 16, 2011

(54) FORMANTS EXTRACTING METHOD COMBINING SPECTRAL PEAK PICKING AND ROOTS EXTRACTION

(75) Inventor: Chan-Woo Kim, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 711 days.

(21) Appl. No.: 10/960,595

(22) Filed: Oct. 6, 2004

(65) Prior Publication Data

US 2005/0075864 A1 Apr. 7, 2005

(30) Foreign Application Priority Data

Oct. 6, 2003 (KR) ..... 10-2003-0069175

(51) Int. Cl.
*G10L 19/06* (2006.01)
*G10L 11/04* (2006.01)
*G10L 19/14* (2006.01)

(52) U.S. Cl. ..... 704/209; 704/219; 704/206; 704/205

(58) Field of Classification Search ..... 704/268, 704/220, 234, 209, 206
See application file for complete search history.

(56) References Cited

U.S. PATENT DOCUMENTS

| | | | | |
|---|---|---|---|---|
| 5,146,539 A | * | 9/1992 | Doddington et al. | 704/241 |
| 5,327,521 A | * | 7/1994 | Savic et al. | 704/272 |
| 5,463,716 A | | 10/1995 | Taguchi | 395/2.18 |
| 6,195,632 B1 | | 2/2001 | Pearson | 704/206 |
| 6,587,816 B1 | | 7/2003 | Chazan et al. | 704/207 |

FOREIGN PATENT DOCUMENTS

| | | |
|---|---|---|
| EP | 0 275 584 A | 7/1988 |
| JP | 07-104796 | 4/1995 |
| KR | 00211965 B1 | 5/1999 |

OTHER PUBLICATIONS

Snell, Roy et al. Formant Location From LPC Analysis Data. Apr. 1993. IEEE Transactions on Speech and Audio Processing. vol. 1. No. 2 Apr. 1993. pp. 129-134.*

Reddy, Sridhar et al. High-Resolution Formant Extraction from Linear-Prediction Phase Spectra. Dec. 1984. IEEE Transactions on Acoustics, Speech, and Signal Processing. vol. ASSP-32, No. 6. Dec. 1984. pp. 1136-1144.*

McCandless, Stephanie S. "An Algorithm for Automatic Formant Extraction Using Linear Prediction Spectra". IEEE Transactions on Acoustics, Speech and Signal Processing, vol. ASSP-22, No. 2, Apr. 1974. p. 135-141.*

* cited by examiner

*Primary Examiner* — Talivaldis Ivars Smits
*Assistant Examiner* — Jesse S Pullias
(74) *Attorney, Agent, or Firm* — Lee, Hong, Degerman, Kang & Waimey

(57) ABSTRACT

In a formants extracting method capable of precisely obtaining formants as resonance frequencies of voice with less computational complexity, the method includes searching a maximum value by a spectral peak-picking method, judging whether the number of formants corresponding to a zero at the obtained maximum point are two, and analyzing a pertinent root by roots polishing when the number of the formants are judged as two. The number of the formants are judged by applying Cauchy's integral formula, wherein Cauchy's integral formula is not applied repeatedly but only once at a surrounding portion of the maximum value in a z-domain.

22 Claims, 3 Drawing Sheets

FORMANTS EXTRACTING METHOD COMBINING SPECTRAL PEAK PICKING AND ROOTS EXTRACTION

CROSS-REFERENCE TO RELATED APPLICATIONS

Pursuant to 35 U.S.C. §119(a), this application claims the benefit of earlier filing date and right of priority to Korean Application No. 10-2003-69175, filed on Oct. 6, 2003, the contents of which are hereby incorporated by reference herein in its entirety.

BACKGROUND OF THE INVENTION

1. Field of the Invention

The present invention relates to identifying formants as resonance frequencies of voice, and in particular to a formants extracting method capable of precisely identifying formants with less computational complexity.

2. Description of the Related Art

Generally, in order to identify formants as resonance frequencies of voice, a spectral peak-picking method for searching a maximum point in a linear prediction spectrum or a cepstrally smoothed spectrum has been largely used. However, because two formants are located closely to each other in most cases, they are shown as one maximum value in the spectrum. In the spectral peak-picking method, although a sufficiently large degree is given to an FFT (fast fourier transform) in order to obtain the spectrum, it is difficult to extract the formants accurately in a frequency region.

To solve the problem, methods for calculating a root in a prediction error filter by using a linear prediction coefficient have been presented. Among them a method for obtaining a root by using a roots extraction method and Cauchy's integral formula presented by R. C. Snell is representative.

In the roots extraction method, a short-time signal is obtained by multiplying either a Hamming window, a Kaiser window or the like by an appropriate section (approximately 20 ms~40 ms) of a voice signal as occasion demands, a linear prediction coefficient and a prediction error filter are obtained from the short-time signal, a zero is obtained from the prediction error filter, and formants are obtained by using an equation of $$F = \frac{f_s}{2\pi}\theta_0.$$

Herein, $\theta_0$ is a phase of a zero, $f_s$ is a sampling-rate of a signal, and F is a formant to be obtained. The roots extraction method is superior to the spectral peak-picking method in the analysis capacity aspect; however, it is impossible to set a definite reference for judging whether actually obtained roots are directly related to formants. In addition, because the roots extraction method has high computational complexity and low precision, it has not been widely used.

The method presented by R. C. Snell is for repeatedly searching a region in which a zero exists in a z-domain by using Cauchy's integral formula. Using this method, computational complexity and precision are improved in comparison with the roots extraction method. However, because a reference for judging whether an actually obtained root is directly related to formants is not represented, reliability is accordingly low.

Therefore, because the conventional methods for obtaining formants have lower analysis capacity, reliability, precision and/or greater computational complexity, it is difficult to analyze formants precisely.

SUMMARY OF THE INVENTION

In order to solve the above-mentioned problems, it is an object of the present invention to provide a formants extracting method capable of precisely identifying formants with less computational complexity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is embodied in a formants extracting method, comprising obtaining a maximum value in a spectrum, judging whether the number of formants corresponding to a zero at a maximum point are two, and analyzing a root by roots polishing when the number of formants are judged as two.

In one aspect, the maximum value may be obtained by a spectral peak-picking method. Moreover, the number of formants may be obtained by applying Cauchy's integral formula. In a detailed aspect, Cauchy's integral formula may be applied to a surrounding area of a point having a maximum value in a specific region, wherein the specific region is a z-domain.

In a further aspect, the root may be a zero corresponding to the number of formants judged as two. Furthermore, either Bairstow's algorithm or an approximation method may be used in the roots polishing.

In another aspect, the extracted formants may be used as a feature vector of voice recognition or for a formants vocoder.

In a more detailed aspect, in receiving a voice signal and analyzing it, a formants extracting method comprises receiving a frame of a new voice signal, pre-processing the received voice signal, multiplying a window function by an appropriate range of the pre-processed voice signal to extract a short-time signal, obtaining a linear prediction coefficient from the extracted short-time signal and obtaining a specific spectrum therefrom, searching maximum points in the specific spectrum and judging whether the maximum points are possibly related to at least two formants, discriminating that the maximum points are actually related to the at least two formants, and analyzing a pertinent root by roots polishing when the maximum points are actually related to the at least two formants.

In one aspect, pre-processing the received voice signal comprises filtering the received voice signal, enhancing the received voice signal or passing the received voice signal through a pre-emphasis filter.

In a further aspect, the appropriate range of the voice signal may be approximately 20 ms~40 ms.

In another aspect, the window function may be a Hamming window function, a Kaiser window function or a Blackman function.

In yet a further aspect, the specific spectrum may be a linear prediction spectrum or a spectrum equalized by a cepstrum.

In yet another aspect, Cauchy's integral formula is used to judge whether the maximum points are actually related to the at least two formants, wherein Cauchy's integral formula is applied to a surrounding portion of a maximum value in a specific region, wherein the specific region is a z-domain.

In a more detailed aspect, Bairstow's algorithm or a root approximation method may be used in the roots polishing.

In one aspect, the root is a zero corresponding to the number of formants judged as two.

In another aspect, the extracted formants are used as a feature vector of voice recognition or for a formants vocoder.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

The present invention relates to a formants extracting method. Hereinafter, the preferred embodiment of the present invention will be described with reference to the accompanying drawings.

Figure 1:
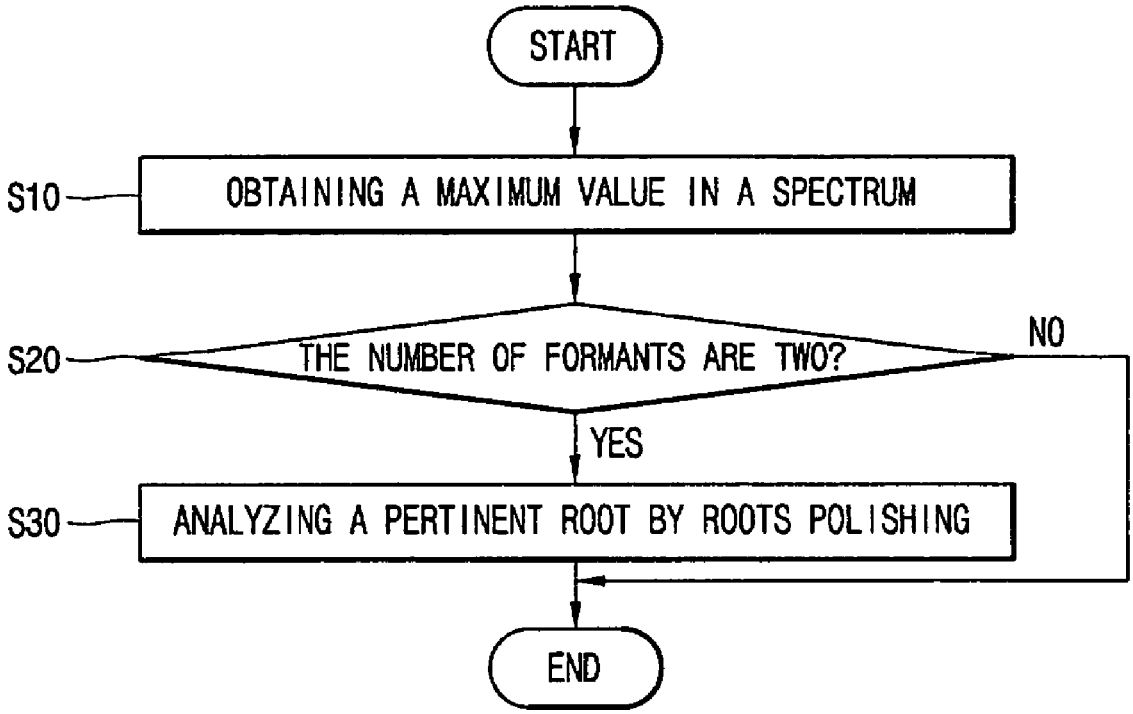
FIG. 1 is a flow chart illustrating a formants extracting method in accordance with an embodiment of the present invention.

FIG. 1 is a flow chart illustrating a formants extracting method in accordance with an embodiment of the present invention. As shown in step S10 of FIG. 1, the formants extracting method comprises searching a maximum value in a spectrum and obtaining maximum points related to formants. At step S20, the method judges whether the number of formants obtained from a zero at the maximum point are two. At step S30, the method analyzes a root by roots polishing when the number of the formants are judged to be two.

Preferably using a spectral peak-picking method, a maximum value as well as maximum points possibly being related to at least two formants are searched in the spectrum, as shown at step S10.

Afterward, by preferably using Cauchy's integral formula, it is examined whether the maximum points are related to one formant or at least two formants as shown at step S20. Herein, Cauchy's integral formula is not repeatedly applied; rather, it is applied to a surrounding region of a point having a maximum value in a z-domain, wherein Cauchy's integral formula may be described by the following equation.

$$n(\Gamma) = \frac{1}{2\pi j}\int_{\Gamma}\frac{A'(z)}{A(z)}dz$$

In the examination result, when it is judged that two formants are added as one, a pertinent zero is analyzed by a roots polishing method, as shown at step S30. Herein, a roots polishing method such as Bairstow's algorithm may be used.

Figure 2:
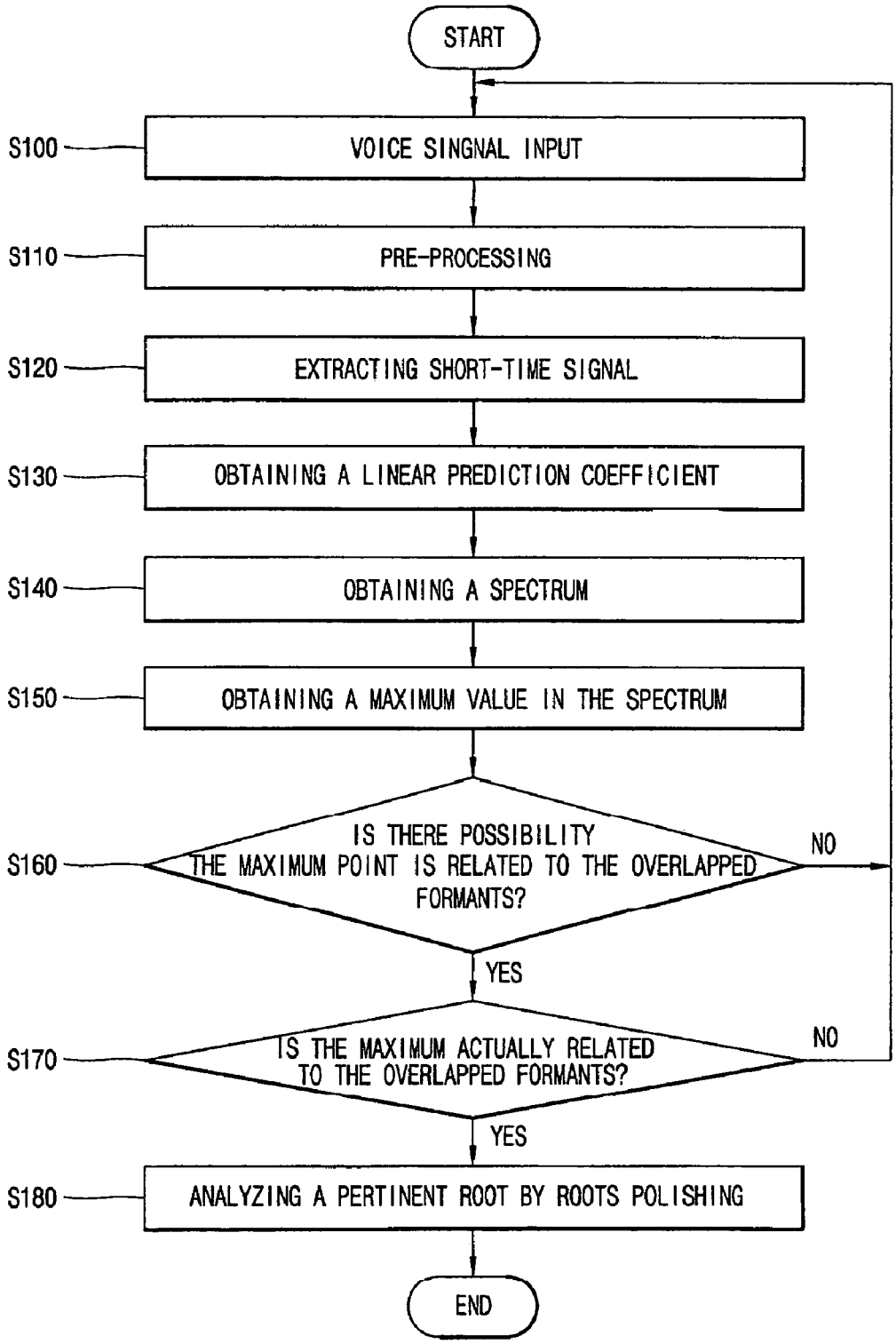
FIG. 2 is a more detailed flow chart illustrating a formants extracting method in accordance with an embodiment of the present invention.

FIG. 2 is a more detailed flow chart illustrating a formants extracting method in accordance with an embodiment of the present invention.

With reference to FIG. 2, after an initial voice signal is received as shown at step 100, it subsequently goes through a pre-processing step, wherein the received signal is filtered, enhanced or passes a pre-emphasis filter as shown at step S110. After the voice signal passes the pre-processing step, an appropriate section (approximately 20 ms~40 ms) of the signal is multiplied by a window function to extract a short-time signal, as shown at step S120.

The window function is for reducing frequency distortion generated from a discontinuous point by reducing a size of the end portion of a cut signal. Generally, a Hamming window function is used. However, a Hanning window function, a Kaiser window function or a Blackman window function may also be used.

Afterward, a linear prediction coefficient is obtained from the extracted short-time signal as shown at step S130, and a linear prediction spectrum or a spectrum equalized by a cepstrum is obtained from the linear prediction coefficient, as shown step S140. Afterward, points corresponding to maximum values in the obtained spectrum are searched, as shown at step S150. At step S160, it is judged whether the maximum points corresponding to the maximum values are possibly related to at least two, namely, overlapped formants. Because there is no need to examine all maximum values, when there is no possibility that two formants are shown as one formant in the spectrum after checking the possible distribution of formants, after-processing is abridged.

Possible distribution of formants required for judging whether there is a possibility related to overlapped formants corresponding to the maximum values is calculated by checking conditions disclosed in Discrete-Time Processing of Speech Signals, New York: Macmillan Publishing Company, 1993 by J. R Dellar Jr., J. G. Proakis, and J. H. L Hansen.

In the meantime, when there is a possibility a maximum point is related to at least two formants, it is judged whether the maximum point is related to one formant or at least two (overlapped) formants by using Cauchy's Integral Formula, as shown at step S170. Herein, with reference to FIG. 3, when only one zero of a prediction error filter exists in a region designated in FIG. 3, after-processing is abridged. In a spectrum in FIG. 3, $\phi_{PEAK}$ indicates a phase of a point corresponding to a maximum value at a z-domain. $\phi 1$ and $\phi 2$ indicate a range in which surrounding two formants can combine. Theoretically, $\phi 1$ and $\phi 2$ are designated as near regions capable of combining two formants with one maximum value. In addition, Cauchy's integral formula is performed by contour integral of a portion inside a bold line in FIG. 3. For example, a constant r is designated as 0.8 or 1.0, etc. It is also possible to select different values.

Figure 3:
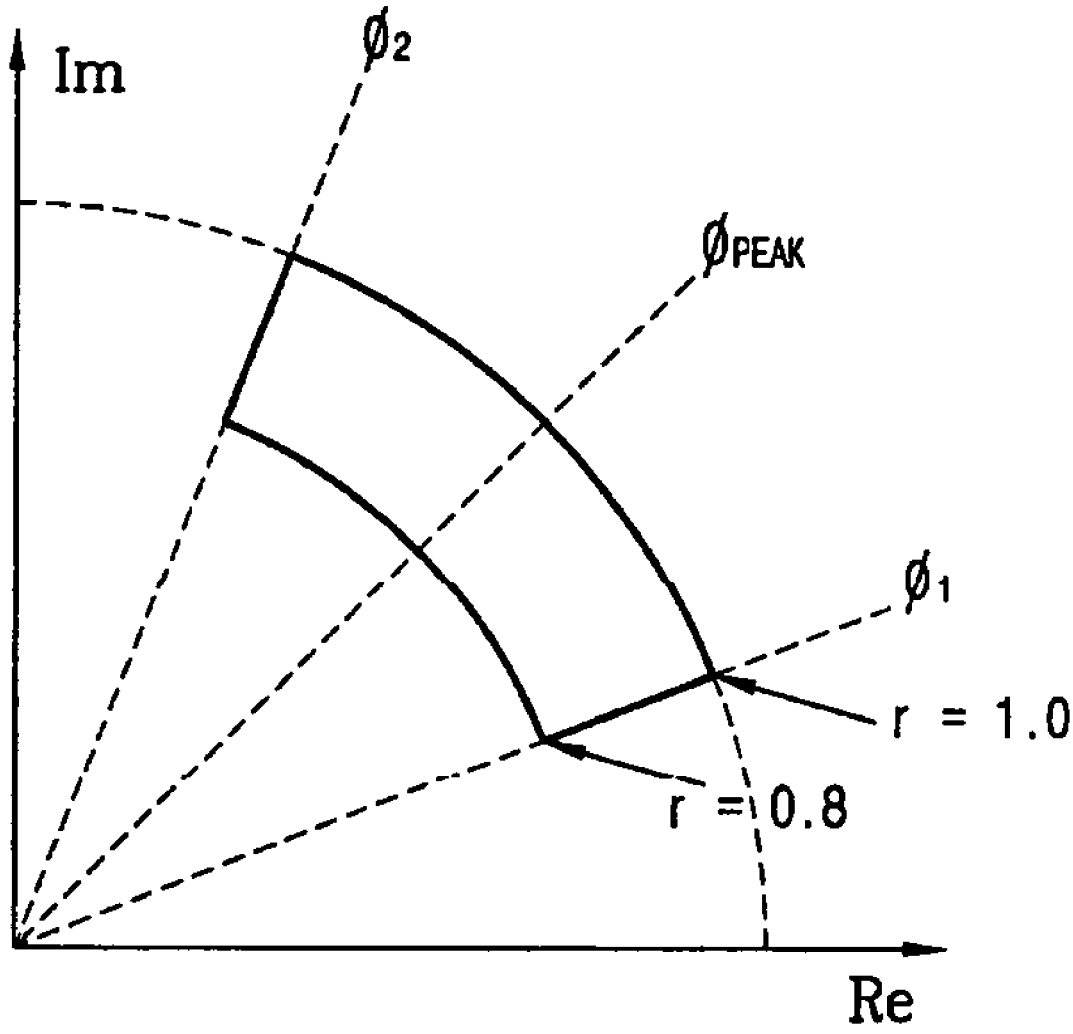
FIG. 3 is a graph illustrating a phase of a maximum value at a z-domain and a combined range of surrounding formants thereof in accordance with an embodiment of the present invention.

When at least two zeros are included in the designated region in FIG. 3, unlike the conventional method calculating an equation having high computational complexity, in the present invention, a pertinent zero is analyzed by roots polishing, as shown at step S180. Herein, methods such as Bairstow's algorithm or a root approximation method can be used. In case of roots polishing, by regarding $$0.9e^{j\frac{\phi_{PEAK}}{2\pi}}$$

in the region (shown in FIG. 3) as a start point, convergence is repeated. In that case, because two roots exist in a relatively small region on the complex plane, by using a recursive method from the start point, a value of the pertinent zero can be obtained quickly without using a root solving method.

As described-above, in the formants extracting method in accordance with the present invention, without using Cauchy's integral formula repeatedly, and by examining only a judged maximum value with the linear prediction spectrum, formants can be precisely searched with less computational complexity. Accordingly, it is possible to reduce operational time and improve reliability in the analyzing capacity aspect. In addition, the obtained formants can be used as a feature vector of voice recognition or for uses such as a formants vocoder or a TTS (text-to-speech), etc.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method of extracting formants, the method comprising:

obtaining maximum values in a spectrum;

obtaining maximum points that are possibly related to overlapped formants by checking a possible distribution of formants;

searching only maximum points related to the overlapped formants, from among the obtained maximum points, by applying Cauchy's integral formula; and extracting the overlapped formants by analyzing a root using roots polishing with respect to the searched maximum points, wherein the maximum points related to the overlapped formants are obtained by:

designating a region capable of overlapping two formants with one maximum value;

examining whether at least two zeros are included in the designated region by applying Cauchy's integral formula only in the designated region to perform a contour integral on the designated region; and determining that a maximum point corresponding to the one maximum value is one of the maximum points related to the overlapped formants, when at least two zeros are included in the designated region.

2. The method of claim 1, wherein the maximum value is obtained by a spectral peak-picking method.

3. The method of claim 1, wherein the designated region is a z-domain.

4. The method of claim 1, wherein the root is a zero corresponding to a number of the overlapped formants determined as at least two.

5. The method of claim 1, wherein the extracted overlapped formants are used as a feature vector of voice recognition.

6. The method of claim 1, wherein the extracted overlapped formants are used for a formants vocoder.

7. A method of extracting formants when receiving and analyzing a voice signal, the method comprising:

receiving a frame of a new voice signal;

pre-processing the received frame of the new voice signal;

multiplying a window function by an appropriate range of the pre-processed frame of the new voice signal to extract a short-time signal;

obtaining a linear prediction coefficient from the extracted short-time signal and obtaining a specific spectrum from the obtained linear prediction coefficient;

obtaining maximum values in a spectrum;

obtaining maximum points that are possibly related to overlapped formants by checking a possible distribution of formants;

searching only maximum points related to the overlapped formants, from among the obtained maximum points, by applying Cauchy's integral formula; and extracting the overlapped formants by analyzing a root using roots polishing with respect to the searched maximum points, wherein the maximum points related to the overlapped formants are obtained by:

designating a region capable of overlapping two formants with one maximum value;

examining whether at least two zeros are included in the designated region by applying Cauchy's integral formula only in the designated region to perform a contour integral on the designated region; and determining that a maximum point corresponding to the one maximum value is one of the maximum points related to the overlapped formants, when at least two zeros are included in the designated region.

8. The method of claim 7, wherein pre-processing the received frame of the new voice signal comprises filtering the received frame of the new voice signal.

9. The method of claim 7, wherein pre-processing the received frame of the new voice signal comprises processing the received frame of the new voice signal.

10. The method of claim 7, wherein pre-processing the received frame of the new voice signal comprises passing the received frame of the new voice signal through a pre-emphasis filter.

11. The method of claim 7, wherein the appropriate range of the pre-processed frame of the voice signal is approximately 20 ms~40 ms.

12. The method of claim 7, wherein the window function is a Hamming window function.

13. The method of claim 7, wherein the window function is a Kaiser window function.

14. The method of claim 7, wherein the window function is a Blackman function.

15. The method of claim 7, wherein the specific spectrum is a linear prediction spectrum.

16. The method of claim 7, wherein the specific spectrum is a spectrum equalized by a cepstrum.

17. The method of claim 7, wherein the designated region is a z-domain.

18. The method of claim 7, wherein Bairstow's algorithm is used in the roots polishing.

19. The method of claim 7, wherein a root approximation method is used in the roots polishing.

20. The method of claim 7, wherein the root is a zero corresponding to the overlapped formants.

21. The method of claim 7, wherein the extracted overlapped formants are used as a feature vector of voice recognition.

22. The method of claim 7, wherein the extracted overlapped formants are used for a formants vocoder.

* * * * *